US005893471A

United States Patent [19]

Zakula

[11] Patent Number: 5,893,471

[45] Date of Patent: Apr. 13, 1999

[54] FREELY-MOVABLE AUXILIARY HOIST FOR A GANTRY CRANE AND METHOD FOR PIVOTING A LOAD

[76] Inventor: Daniel Brian Zakula, 19641 Therese La., Mokena, Ill. 60448

[21] Appl. No.: 08/869,400

[22] Filed: Jun. 5, 1997

[51] Int. Cl.[6] ..... B66C 19/00

[52] U.S. Cl. ..... 212/345; 212/316; 212/326; 212/330; 212/336

[58] Field of Search ..... 212/316, 323, 212/318, 330, 335, 336, 343, 344, 345, 324, 326, 327

[56] References Cited

U.S. PATENT DOCUMENTS

| | | | |
|---|---|---|---|
| 1,430,009 | 9/1922 | Harry . | |
| 3,075,603 | 1/1963 | Baudhuin . | |
| 3,081,883 | 3/1963 | Minty . | |
| 3,297,170 | 1/1967 | McCready et al. . | |
| 3,389,809 | 6/1968 | Wilson . | |
| 3,513,987 | 5/1970 | Seyff | 212/316 |
| 3,854,592 | 12/1974 | Mordre . | |
| 3,874,516 | 4/1975 | Watanabe | 212/323 |
| 3,999,672 | 12/1976 | Brock . | |
| 4,144,974 | 3/1979 | Longthorpe . | |
| 4,360,112 | 11/1982 | Brewer . | |
| 4,360,304 | 11/1982 | Brewer . | |
| 4,544,070 | 10/1985 | Sickler . | |
| 4,657,150 | 4/1987 | Glickman et al. . | |
| 4,749,328 | 6/1988 | Lanigan . | |

FOREIGN PATENT DOCUMENTS

| | | | |
|---|---|---|---|
| 1756299 | 3/1970 | Germany | 212/316 |

*Primary Examiner*—Thomas J. Brahan
*Attorney, Agent, or Firm*—Leydig, Voit & Mayer

[57] ABSTRACT

A hoist assembly is provided for an overhead crane adapted for pivoting wide panels and the like between horizontal and vertical positions. The hoist assembly is supported on an elevated horizontal beam and includes a main trolley, supporting a main lifting cable, and an auxiliary trolley, supporting an auxiliary lifting cable. The main trolley is mounted for positively drivable movement along the horizontal beam, while the auxiliary trolley is freely slidable along the horizontal beam. The freely slidable auxiliary trolley automatically moves along the beam in response to a horizontal force component of cable tension when a load is being pivoted, so that the auxiliary trolley maintains a substantially vertical position over its lifting point on the load. A method for pivoting a load with the hoist assembly is also provided.

18 Claims, 6 Drawing Sheets

FREELY-MOVABLE AUXILIARY HOIST FOR A GANTRY CRANE AND METHOD FOR PIVOTING A LOAD

FIELD OF THE INVENTION

The present invention generally relates to a hoist mechanism for an overhead crane and more particularly to a hoist mechanism for lifting and pivoting large panels between horizontal and vertical orientations.

BACKGROUND OF THE INVENTION

Overhead gantry cranes are generally known for lifting heavy items. For example, such cranes are used for handling large products or containers and transporting them to and from storage or loading containers on ships, trains, trucks, etc. These cranes are commonly used in the construction industry as well, handling large construction materials, such as beams, blocks, concrete barriers, pipeline sections, prefabricated components, etc.

Known cranes of a type referred to herein usually include two parallel horizontal beams which are supported in an elevated fashion by a frame. Each of these horizontal beams is equipped with a lifting hoist trolley which is actively traversible along the horizontal beam in a motorized manner by a positive drive system. Each trolley is a part of a hoist having a separate lifting cable system operable to lift a load, usually with a lifting block suspended by the cable from the trolley. For moving the entire crane, the frame is mounted on drivable and steerable wheels so that an operator can drive the crane over a site to lift or deposit a load at a desired location.

A specific example of a crane application is in the prestressed concrete industry, where gantry cranes are used for handling slabs or panels of formed concrete. These concrete panels are conventionally cast in a horizontal position, but often must be stored and/or transported in a vertical orientation. Therefore, after casting, the concrete panels must not only be lifted, but also must be pivoted from horizontal to vertical orientations for storage or transport. Additionally, at a construction site these concrete panels must be removed from vertical cargo or storage positions and be pivotally positioned horizontally for installation, e.g., as flooring sections.

Because concrete panels can weigh several tons apiece, and because they are breakable, these handling situations require careful crane operation to pivot the load. Load pivoting has conventionally been accomplished by a crane equipped with two positively-driven hoist trolleys on each of the two horizontal beams, for a total of four positively-driven hoist trolleys per crane. On each beam, one of the hoists is operated to lift one side of the load, while the second hoist is operated to lift the other side of the load. Then, by raising or lowering only one of the hoists, that side of the load is accordingly raised or lowered, "pivoting" the load.

Because the panel may have a substantial width dimension, the two hoist trolleys per beam must be drivably positioned at generally that same panel-width dimension apart from each other, vertically above the respective sides of the horizontal panel. To pivot the panel to a substantially vertical orientation, the two hoist trolleys on the beam must be positively driven closer to each other during the pivoting operation (while one of the hoists lifts or lowers its side of the panel). Likewise, the two hoist trolleys must be positively driven apart from each other while pivoting a panel from a vertical to a horizontal position. With such a crane having dual positively-driven hoists, pivoting a wide load has proven to be tedious, as it requires an operator to actively control the lateral movement of one or both positively-driven hoists while simultaneously controlling the lifting movement. It is desirable to reduce the number of control functions performed by a human operator in order to increase productivity and accuracy.

It has also been known to use two entire overhead crane vehicles to perform a lifting and pivoting of a single load. One hoist from each of the two cranes lifts a respective end of the item, and the coordinated raising or lowering of the two independent hoists is operable to pivot the load. During the pivot, the two cranes can be moved closer or farther from each other in order to obtain a correct pivot angle.

The use of two cranes is impractical for several reasons. Where two cranes are used, additional costs are required for the purchase of a second crane and employment of a second crane operator. Also, it is difficult for two crane operators to coordinate separate cranes to carry out the calculated task of lifting and pivoting a multi-ton object.

Thus, lifting and pivoting with conventional cranes has required expensive components, either in the form of a second crane or in equipping a crane with dual positively-driven hoists.

It is further noted that cranes are known wherein a single trolley carries two hoists, particularly for lifting and dumping a bucket-like vessel. For example, such devices are disclosed in U.S. Pat. Nos. 3,297,170, 3,854,592, 4,144,974, and 4,360,304. These trolleys might be suitable for pivoting a bucket or some other load which does not have a substantial width dimension, however, they are not suited for pivoting wide objects such as panels. In particular, the hoists are fixed closely together in these devices. If used to lift and pivot a load suspended at widely-separated lifting points, the cables would be lifting at non-vertical angles, thereby subjecting them to amplified tensile stress due to both vertical and horizontal force components. Other structural elements of the hoists would also be subjected to such amplified stress, such as the trolley sheaves over which the cables run, the hoist winches, etc. Therefore, it is desirable to provide a crane capable of maintaining a substantially vertical cable orientation during the lifting and pivoting of a load.

SUMMARY AND OBJECTS OF THE INVENTION

The present invention overcomes the disadvantages of the prior art by providing an auxiliary hoist assembly to be used on a crane in conjunction with a main hoist assembly, wherein the auxiliary hoist assembly has an independent trolley that is freely moveable along a horizontal support beam instead of being positively controlled by a powered positioning means along the beam. Accordingly, the present invention reduces equipment costs, since there is no need for expensive trolleydriving equipment in conjunction with the auxiliary hoist assembly, such as hydraulic cylinders or motorized drives.

A crane of the type referred to herein preferably has twin front and rear lifting means (on the front and rear horizontal beams) used in tandem with each other. For clarity, some of the following description refers to only one of these structures, but in the preferred embodiment, the crane includes cooperating front and rear sets of the described hoist elements.

According to an embodiment of the invention, the auxiliary hoist assembly includes an auxiliary trolley which is mounted for freely glidable or slidable movement along the beam. The beam also supports a main trolley which is not freely-movable, but rather is positively positioned on the beam by a drive means. The main and auxiliary trolleys support main and auxiliary lifting cables, respectively, which are selectively operable to lift a load. Because the auxiliary trolley is freely slidable, a horizontal force component through tension on the auxiliary lifting cable causes a corresponding automatic horizontal repositioning of the auxiliary trolley along the beam.

For lifting and pivoting a load, the auxiliary hoist assembly and main hoist assembly are used in conjunction with each other. According to the present invention, when a load is supported at respective lifting points by the main and auxiliary hoists, the load may be pivoted by actuating one of the hoist cables. Preferably, this pivoting operation is performed by retracting the auxiliary lifting cable while not retracting the main lifting cable. This causes a pivoting moment on the load around the main lifting cable lifting point. As the load pivots, the auxiliary hoist trolley automatically slides along the beam vertically above its lifting point on the load.

An advantage of the present invention is that it permits both a main and auxiliary hoist trolleys to be positioned substantially vertically over the respective load lifting points load during pivoting. Because the auxiliary hoist is automatically movable along the beam, both the main lifting cable and auxiliary lifting cable are subjected only to substantially vertical load components.

A related advantage is that an operator does not have to control the position of an auxiliary trolley along the beam while a load is pivoted.

A further advantage is that, because the lifting cables are subjected only to substantially vertical lifting loads, the lifting cable are subjected to less tensile stress than in prior art devices wherein lifting cables are subjected to non-vertical lifting angles. Thus, a device according to the invention is less susceptible to failure and wear, and may also be designed within lower load limits.

BRIEF DESCRIPTION OF THE DRAWINGS

These and other features and advantages of the invention will be more readily apparent upon reading the following description of a preferred exemplified embodiment of the invention and upon reference to the accompanying drawings wherein:

FIGS. 6 is a fragmentary rear elevation of a crane according to an embodiment of the invention wherein a main and auxiliary hoist are lifting a panel in horizontal orientation;

FIG. 7 is a fragmentary rear elevation of the crane of FIG. 6 wherein the main and auxiliary hoists are supporting the panel in a substantially vertical orientation, showing the angle Φ that a panel is pivoted from a horizontal to a substantially vertical orientation;

FIG. 8 is a fragmentary rear elevation of a crane wherein the main trolley has been driven and abutting contact against the auxiliary trolley to reposition the auxiliary trolley for lifting a horizontally-oriented load;

FIG. 9 is a fragmentary rear elevation of the crane of FIG. 8 wherein the main trolley has been driven away from the repositioned auxiliary trolley so that both the main and auxiliary lifting hoist are ready to lift a horizontally-oriented load.

While the invention will be described in connection with certain preferred embodiments, there is no intent to limit to those embodiments. On the contrary, the intent is to cover all alternatives, modifications and equivalents included within the spirit and scope of the invention as defined by the appended claims.

DESCRIPTION OF THE PREFERRED EMBODIMENT

Figure 1:
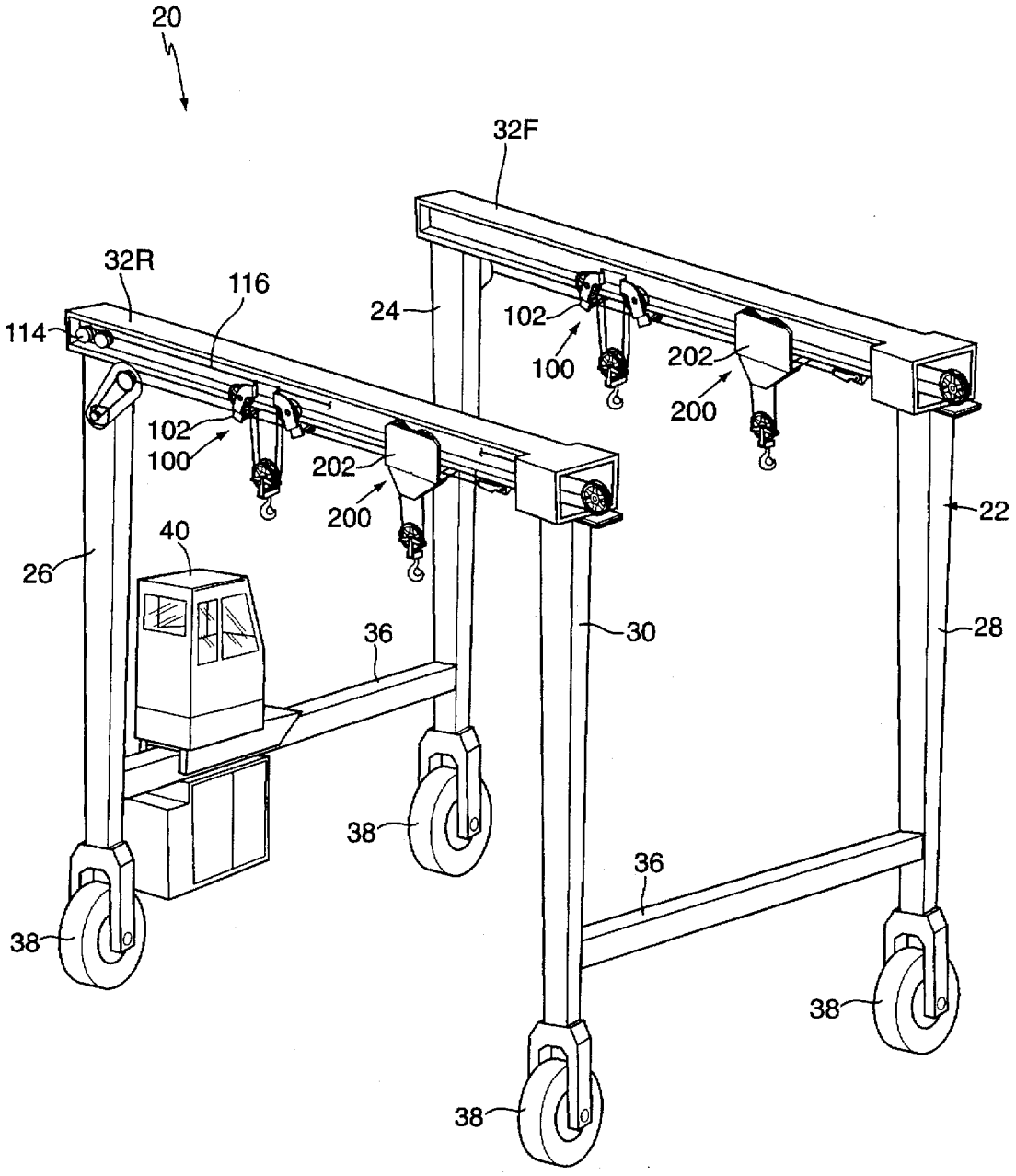
FIG. 1 is a isometric view of a crane utilizing the present invention.

Now referring to the drawings, wherein like numerals designate like parts, FIG. 1 shows an overhead crane 20 having a frame 22. The frame 22 includes four corner-located vertical columns 24, 26, 28, and 30 which support front and rear transversely-mounted elevated horizontal beams 32F and 32R, respectively. The frame 22 also includes a pair of side members 36 connected between respective columns in a front-to-back alignment at the right and left of the crane 20. Wheels 38 are mounted under the columns 24, 26, 28, 30 for drivably maneuvering the crane 20 over the ground. A cab 40 is mounted on one of the side members 36 of the frame from which an operator can drive and operate the crane 20. In general, the crane 20 is configured to be maneuverable to position the elevated horizontal beams 32F, 32R over large loads to be handled.

In a preferred embodiment, the front and rear horizontal beams 32F, 32R are each provided with a main hoist assembly 100 and, according to the invention, an auxiliary hoist assembly 200. This is illustrated in greater detail in FIGS. 2 and 3 which illustrate the hoist assemblies 100, 200 at rear and front horizontal beams 32R, 32F, respectively. It should be understood that, in a preferred embodiment, both the front and rear of the crane 20 are equipped with main and auxiliary hoist assemblies arranged at like sides of the crane.

Figure 2:
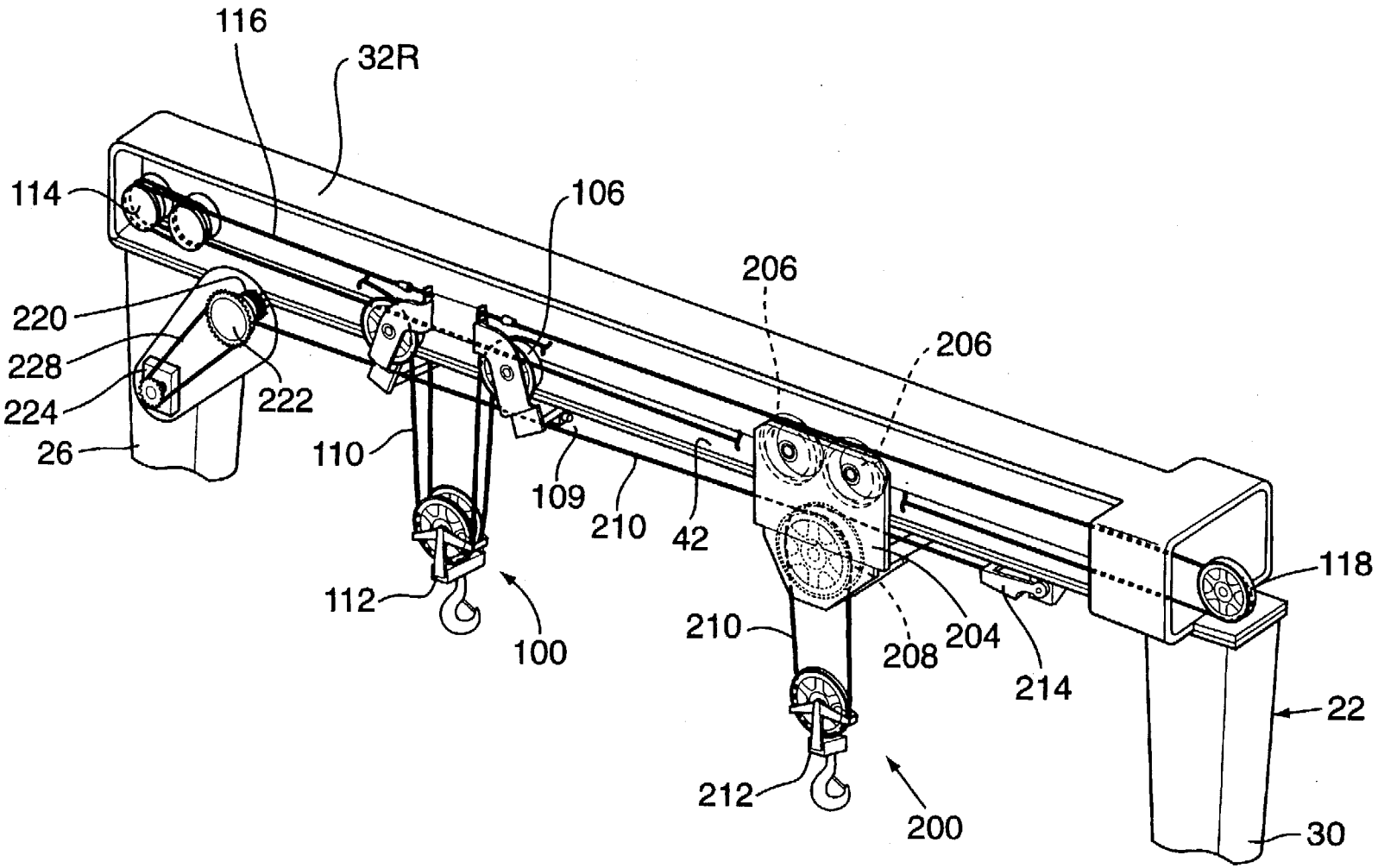
FIG. 2 is a fragmentary perspective view of a rear beam assembly of the crane of FIG. 1 showing the auxiliary lifting cable the main trolley drive mans, but, for clarity, much of the main lifting cable is not shown.
Figure 3:
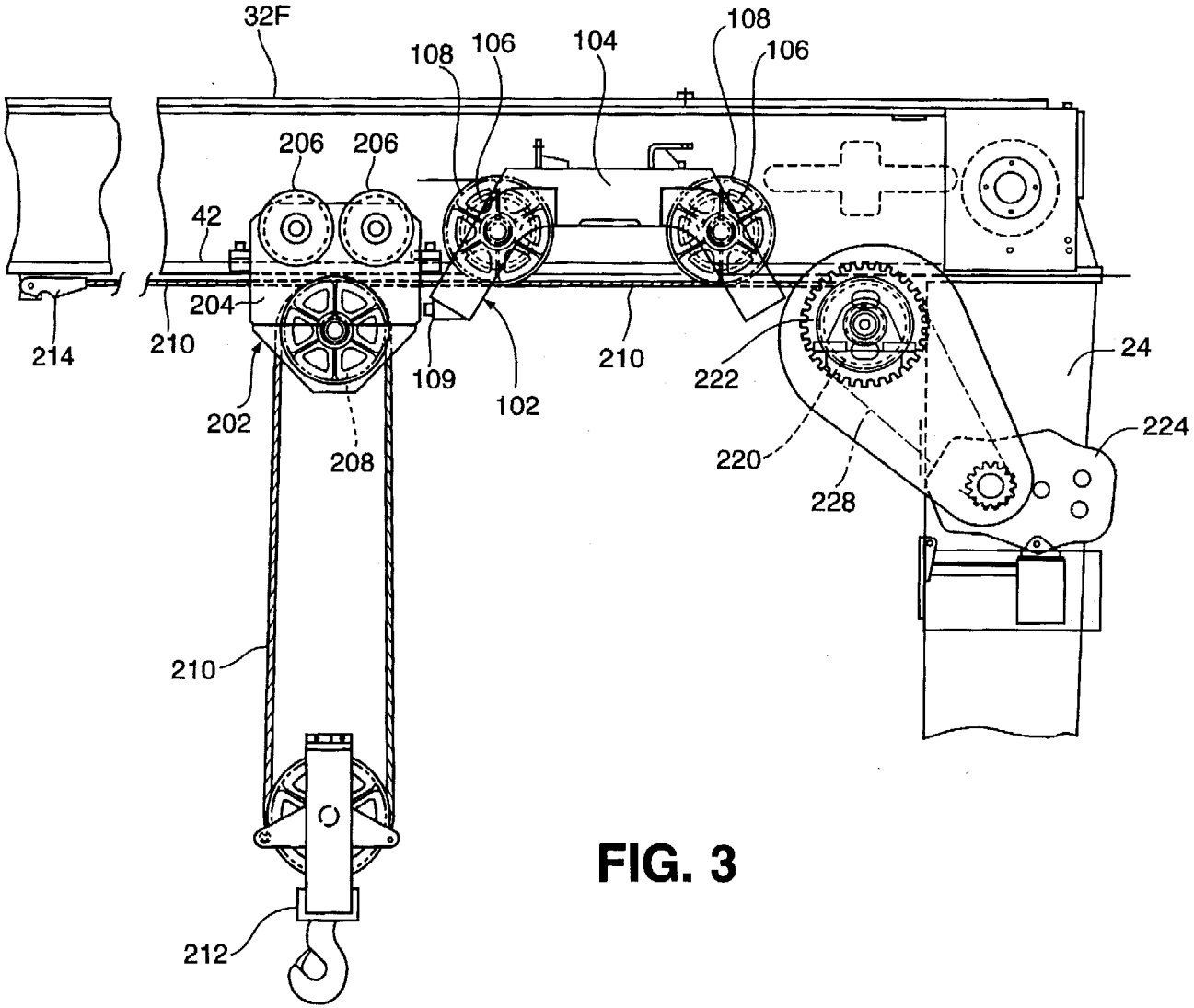
FIG. 3 is a fragmentary front elevation of the front horizontal beam of the crane, showing the auxiliary hoist assembly and the main trolley.

As shown in FIGS. 2 and 3, the horizontal beams 32F and 32R are I-beams, each having a bottom flange 42. The main hoist assembly 100 includes a main trolley 102 which guidably rides along the bottom flange 42. The main trolley 102 includes a main trolley body 104 to which a plurality of roller wheels 106 are mounted for rollably supporting the main trolley 102 on the bottom flange 42. The main trolley 102 further includes a plurality of pulleys or sheaves 108 rotatably mounted to the main trolley body 104.

For vertically lifting a load toward the main trolley 102, each main hoist assembly 100 includes a main lifting cable 110 which is guided over the sheaves 108. The main lifting cable 110 operably supports a main hook block 112 hanging below the main trolley 102. The routing of the main lifting cable 110 and other details of the main hoist assembly are described in greater detail below in connection with FIG. 5.

Figure 6:
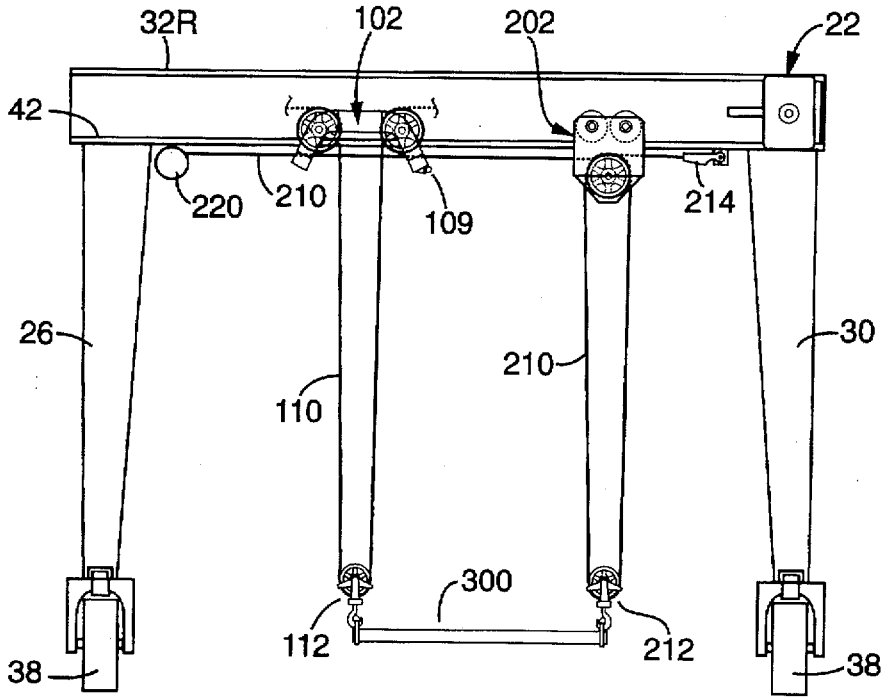
FIGS. 6–9 illustrate a crane during various stages of a lifting and pivoting cycle.

The main trolley 102 is positively driven along the horizontal beam by a drive means. FIG. 2 illustrates one conventional drive means for positively positioning the main trolley 102. As illustrated in FIG. 6, a motor-operated friction drive 114 moves a looped wire rope or drive cable 116 having ends oppositely secured to the main trolley 102. The drive cable 116 follows along the length of the horizontal beam 32R, passing over a rotatable pulley 118 at side of the frame 22 opposite the friction drive 114. The looped drive cable 116 is thereby caused to circulate, positively driving the main trolley 102 to desired positions along the beam 32R. Other drive means are possible, such as a conventional chain drive or other drives.

Figure 4:
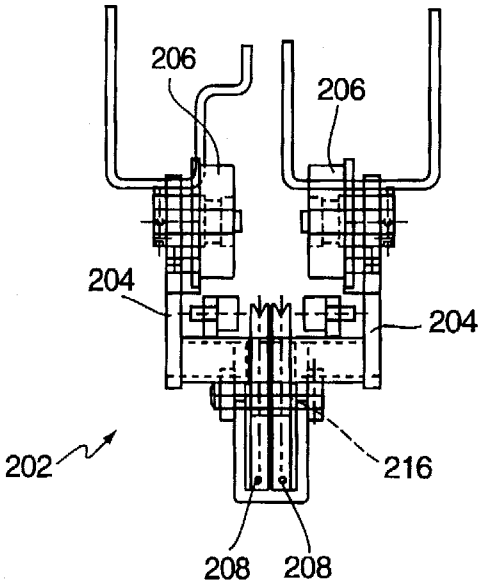
FIG. 4 is a side elevation of the auxiliary trolley.

According to the invention, still referring to FIGS. 2 and 3, each auxiliary hoist assembly 200 includes an auxiliary trolley 202 which is freely slidable along the respective horizontal beam 32F, 32R. The auxiliary trolley 202 has a trolley body 204, preferably including a plurality of roller wheels 206, which are also shown in FIG. 4. The roller wheels 206 are positioned to rollably glide along an upwardly-facing surface of the bottom flange 42. Also rotatably mounted to the trolley body 204 are one or more pulleys or sheaves 208.

For vertically lifting a load toward the auxiliary trolley 202, the auxiliary hoist assembly 200 includes an auxiliary lifting cable 210 which is movably supported on the auxiliary trolley 202 by the sheaves 208. A first end of the auxiliary lifting cable 210 is coiled around an auxiliary hoist drum 220 which is rotatably mounted to the frame 22 near the left column 26 (FIG. 2), 24 (FIG. 3). The auxiliary hoist drum 220 has a sprocket 222 fixed at one side. The sprocket is drivable by a motor 224 via a gear box and drive chain 228 to rotate the drum 220 for feeding and retracting the auxiliary lifting cable 210. The motor 224 is preferably a hydraulic motor, but the motor 224 may instead be electric or some other type of motor.

The auxiliary lifting cable 210 extends from the drum 220 parallel to an underside of the horizontal beam 32F, 32R, passing freely through the main trolley 102 to the auxiliary trolley 202. The auxiliary lifting cable 210 then forms a loop over the auxiliary hoist trolley 202 in a manner guidably supported by the rotating sheaves 208, this loop supporting an auxiliary hook block 212 hanging below the auxiliary trolley 202.

More specifically, the auxiliary lifting cable 210 extends from the auxiliary hoist drum 220 over a first one of the sheaves 208, extends vertically downwardly to wrap under a sheave 208 which is rotatably mounted to the hoist block 212. From the hoist block 212, the auxiliary lifting cable 210 turns upwardly to the trolley 202 through which the cable is rollably guided by a second one of the sheaves 208 of the auxiliary trolley 202. From there, the auxiliary cable 210 follows below the horizontal beam to a dead end mount 214 secured to the frame 22 opposite the auxiliary hoist drum 220. In the embodiment illustrated in FIG. 2, the dead end mount 214 is secured to an underside of the horizontal beam near the right column 30, opposite the drum 220.

By actuating motor 224 to drive the auxiliary hoist drum 220, the auxiliary lifting cable 210 is selectively fed or retracted, resulting in a respective lowering or raising of the auxiliary hook block 212.

As mentioned, the auxiliary trolleys 202 are freely slidable along the horizontal beams 32F, 32R. As the auxiliary trolleys 202 slide, the auxiliary lifting cable 210 guidably circulates over the sheaves 208, passing through the auxiliary trolley body 204. Some frictional resistance is present at the sheaths 208, cable 210, and roller wheels 206, however a significant horizontal component of tension in the auxiliary hoist cable 210 below the auxiliary trolley 202 in a direction parallel to the beam will overcome such friction. Accordingly, the auxiliary trolley 202 automatically glides along the beam in response to the horizontal cable tension component so that the auxiliary trolley 202 effectively maintains a substantially vertical position over the auxiliary hook block 212. Although the auxiliary hook block 212 ideally would be kept vertically under the auxiliary trolley 202, the discussed frictional effects in actual use cause the alignment to be normally somewhat non-vertical. As used herein, the term "substantially vertical" includes this slightly non-vertical alignment as within the scope of the invention, and also the term "substantial horizontal force component" is meant as a force at least great enough to overcome the friction of the auxiliary trolley 202.

According to the invention, the auxiliary trolley 202 is non-driven in relation to its position on the horizontal beam 32F, 32R. In contrast, the conventional main trolley 102 is positively positioned on the beam 32F, 32R via a driving means, which is illustrated in FIG. 2.

Turning to FIG. 4, the auxiliary trolley 202 is shown in greater detail. Preferably, the trolley 202 has a total of four roller wheels 206 which are arranged in opposing pairs so that two of the roller wheels ride on each side of the bottom flange 42 (FIGS. 2 and 3). Each of the illustrated roller wheels 206 has an annular flange which overhangs an edge of the beam flange 42 to guidably position the roller wheel 26. The auxiliary trolley body 204 is generally U-shaped as illustrated in FIG. 4, so that the roller wheels 206 are mounted at upper portion of the trolley body 204. The sheaves 208 are rollably mounted at a lower portion of the trolley body 204, preferably, on a common axle 216.

Figure 5:
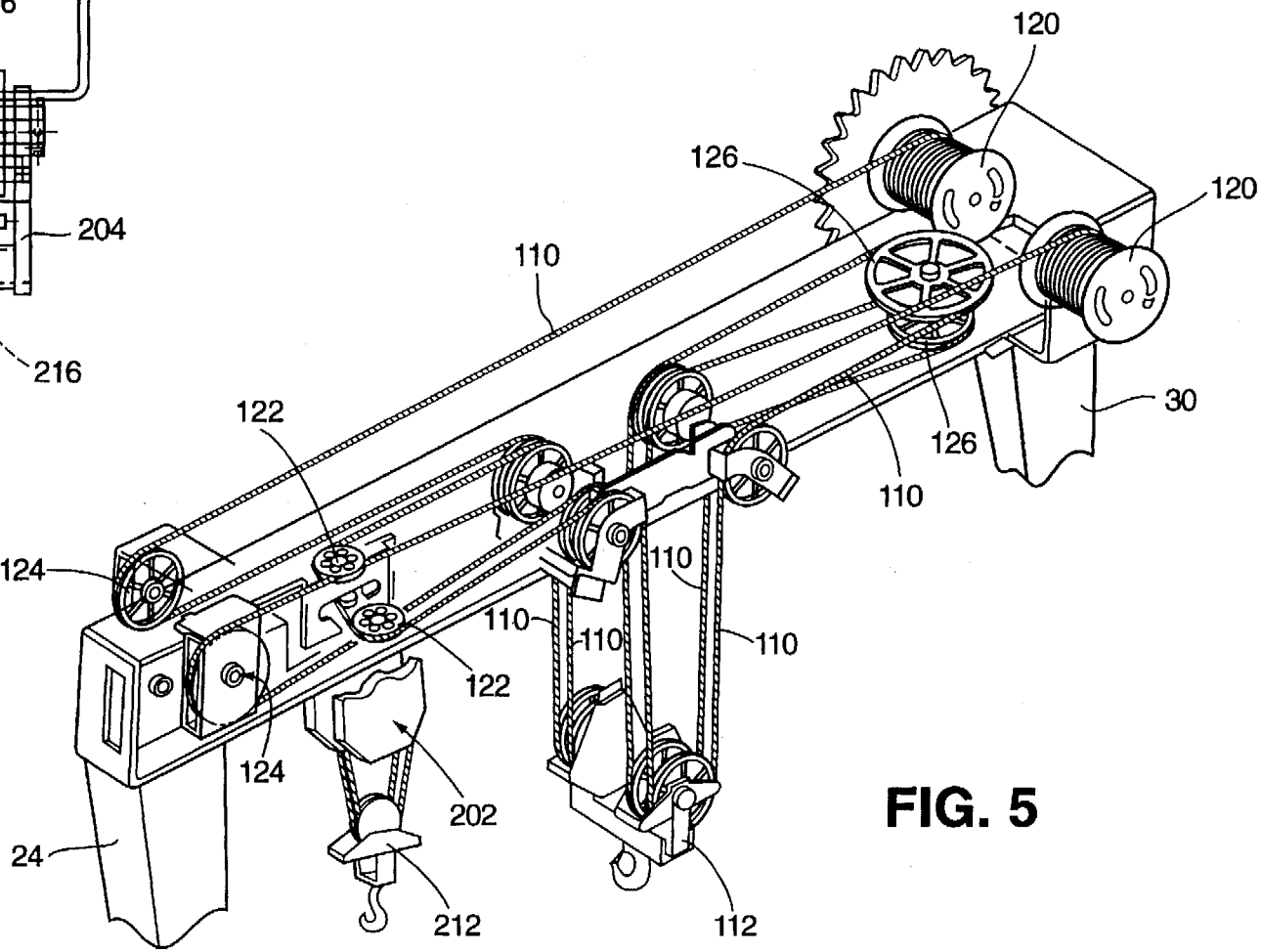
FIG. 5 is a fragmentary perspective view of the beam assembly of the crane of FIG. 1, illustrating routing of the main lifting cable but, not showing the main trolley drive means or auxiliary lifting cable routing.

For raising and lowering the main hook block 112, each main lifting hoist 100 includes a conventional cable lifting system, such as that shown in FIG. 5. For clarity, certain elements have been omitted from FIG. 5, such as the main trolley drive system (see FIG. 2) and details of the auxiliary cable lifting means (see FIGS. 2 and 3). As illustrated in FIG. 5, the main lifting cable 110 has opposite ends coiled around main lifting drums 120 which are drivably rotatable by a motor. The main lifting cable 110 is guided over a plurality of pulleys 122, 124, 126 mounted to the horizontal beam 32F and extends over the sheaves 108 of the main trolley 102 to support the main hook block 112. Actuation of the main lifting drums 120 is effective to retract or feed the main lifting cable 110, resulting in the raising or lowering of the main hook block 112.

For lifting and pivoting a load, the main hoist assembly 100 and auxiliary hoist 200 assembly are used in conjunction with each other. FIGS. 6–9 illustrate the main hoist assembly 100 and auxiliary hoist assembly 200in successive stages of cooperative operation during a process of lifting and pivoting a panel-like load, then resetting the trolleys in position for repeating the process. FIG. 6 shows the main hook block 112 and auxiliary hook block 212 secured at separate connecting points of a horizontal panel 300. The main and auxiliary lifting cables 110, 210 have been set so that the respective main and auxiliary hook blocks 112, 212 are at about the same vertical heights. The main and auxiliary trolleys 102, 202 are positioned substantially vertically above the respective connection points of the hook blocks 112, 212 to the panel 300.

Figure 7:
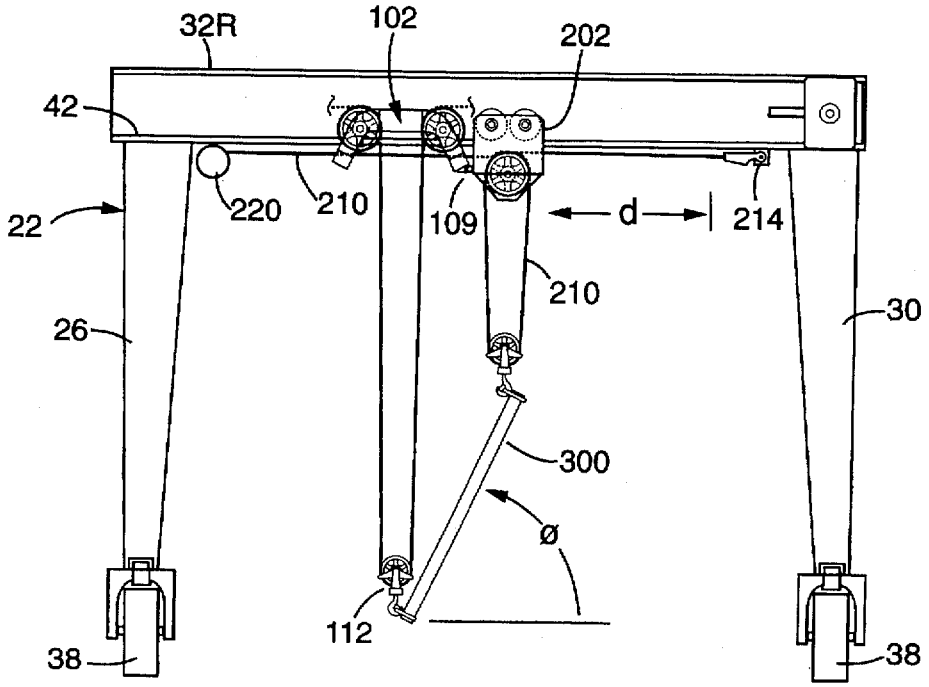

The auxiliary hoist drum 220 is then actuated to retract the auxiliary lifting cable 210, causing an upward lifting of the auxiliary hook block 212. When the auxiliary hook block 212 is moved vertically relative to the main hook block 112, the panel 300 is caused to pivot, as illustrated in FIG. 7. In FIG. 7, the panel 300 has pivoted by an angle Φ to a substantially vertical position. (It is recognized that the dimensions of the trolleys 102 and 202 prevent a completely vertical orientation of the panel 300 unless either main or auxiliary the lifting cable is slackened). The main trolley 102 is undriven, remaining stationary, however, the auxiliary trolley 202 automatically maintains a substantially vertical position over the auxiliary hook block 212, moving a distance d along the horizontal beam to a position where the auxiliary trolley 202 abuts the main trolley 102. A rubber bumper 109 is mounted to the main trolley body 104 for cushioning contact between the main trolley 102 and auxiliary trolley 202. The panel 300 may then be released in the substantially vertical position.

Figure 8:
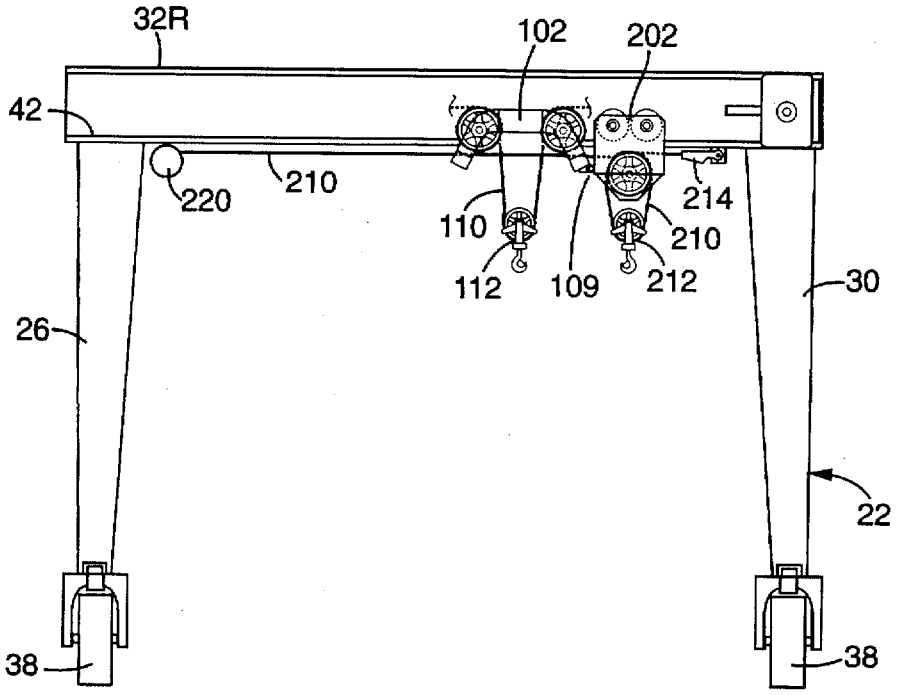
Figure 9:
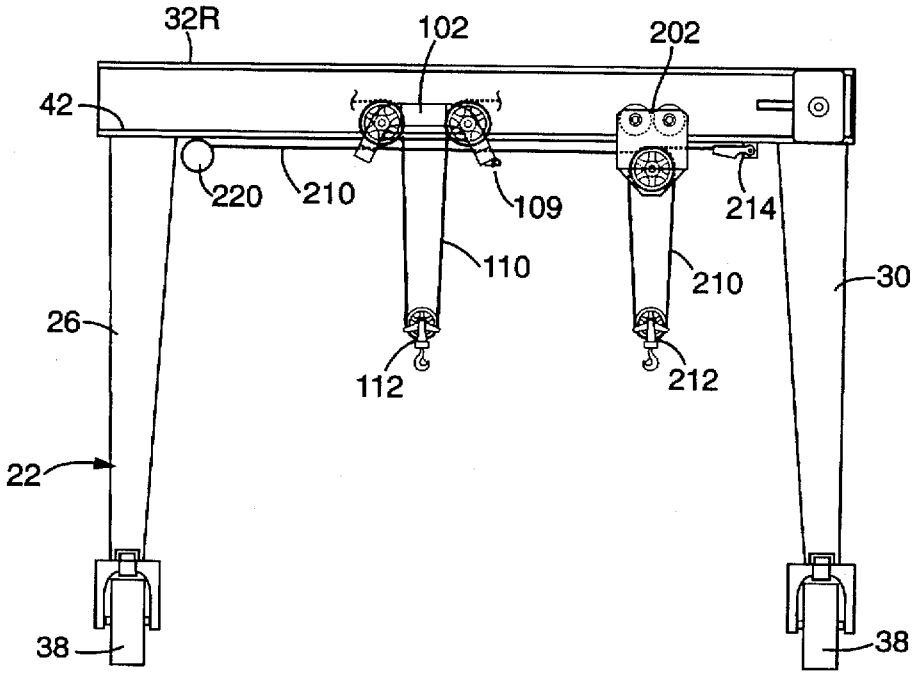

To reposition the freely-movable auxiliary trolley 202 for lifting another load, the main trolley 102 is positively driven to push the auxiliary trolley 202 to the desired position, as shown in FIG. 8. The main trolley 102 can then be driven in the opposite direction, returning to its initial lifting position, shown in FIG. 9, so that the lifting and pivoting cycle can be repeated.

It should be noted that the device of the invention may also be used in a reverse manner to lift a panel from a substantially vertical position and pivot it to a horizontal position. For such a process, the auxiliary trolley 202 is initially positioned close to the main trolley 102, as shown in FIG. 7. The auxiliary lifting cable 210 is then fed out by the drum 220 in order to lower the auxiliary lifting block 212 and pivot the panel 300 to a horizontal position, as shown in FIG. 6. Again, the auxiliary trolley follows substantially vertically above the auxiliary hook block 212, automatically traveling the distance d (FIG. 7) when the panel 300 pivots.

Although the illustrated operation pivots the panel 300 by retracting and feeding the auxiliary lifting cable 210, the crane 20 of the invention could also be used to pivot a panel 300 by feeding or retracting the main lifting cable 110 while the length of the auxiliary lifting cable 210 remains the same. In such an operation, the auxiliary trolley 202 will still automatically freely slide along the horizontal beam 32 so that the main and auxiliary trolleys 102, 202 maintain a substantially vertical position over the their respective blocks 112, 212 and associated lifting points.

Additionally, FIGS. 6–9 show the hook blocks 112 and 212 connected at opposite sides of the panel 300, separated by the entire panel width. While such a connection would achieve a desirable pivoting moment, it is not necessary that the connection points be at the panel ends. Rather, the hook blocks 112, 212 could be connected at various mid-points across the panel width, if the respective connection points are separated by a distance. In fact, in one embodiment, the main hook block 112 may be connected at a center of gravity of the panel 300 while the auxiliary block 212 is connected at some distance away, so that the auxiliary lifting cable 210 is required only to provide a pivoting moment without actually exerting a lifting force.

In conventional cranes, individual hoist assemblies are separately actuatable for traversal and lifting by respective manually-operated control levers located in the cab. For example, a separate lever has conventionally been provided for the traversal and lifting functions for each of the hoists, both in the front and rear of the crane. However, it is known to place the driving and lifting levers in side-by-side groups for convenient simultaneous operation (e.g., front and rear trolley driving levers would be located side-by-side, and front and rear hoist lifting levers would be located side-by-side).

In the present crane 20, equipped with auxiliary hoist assemblies 200 according to the invention, actuation levers (not shown) are preferably also mounted conveniently in the cab 40. Front and rear main lifting actuating levers may be located side-by-side, and front and rear main trolley driving actuation levers may be located side-by-side. Levers for actuating the front and rear motors 224 to move the auxiliary lifting cables 210 may also mounted side-by-side in a group. This group of auxiliary cable actuation levers may be mounted beside the main lifting cable actuation levers to permit convenient actuation of simultaneous four-point lifting of a load with the main and auxiliary hoist assemblies.

As a related feature, the main and auxiliary lifting hoist assemblies 100, 200 are preferably cooperatively tuned such that the main hoist blocks 112 and auxiliary hoist blocks 212 lift and lower at the same rate upon actuation. In the preferred embodiment wherein the auxiliary and main cables 210, 110 are driven by respective hydraulic motors, a variable displacement load sensing pump is provided with manually-actuated direction valves (one for each hoist) individually actuatable by the aforementioned levers. Lifting speed of the hook blocks 112, 212 is controlled by the amount that the direction valves are opened.

In the embodiment illustrated in the FIGS., it is noted that the auxiliary lifting cable 210 makes one U-pass through the auxiliary hook block 212, but that the main lifting cable 110 makes two U-passes through the main hook block 112. Therefore, the main cable 110 must be retracted at twice the rate of the auxiliary cable 210 in order to lift the main hook block 112 and auxiliary hook block 212 at the same rate. Of course, it is possible to provide an auxiliary hoist assembly according to the invention which loops the auxiliary lifting cable 210 more than once, e.g. making two U-passes through the auxiliary lifting block.

While the invention is described herein in connection with certain preferred embodiments, there is no intent to limit it to those embodiments. On the contrary, it is recognized that various changes and modifications to the described embodiments will be apparent to those skilled in the art, and that such changes and modifications may be made without departing from the spirit and scope of the invention. Accordingly, the intent is to cover all alternatives, modifications, and equivalents included within the spirit and scope of the invention as defined by the appended claims.

What is claimed is:

1. A gantry crane comprising:

at least a first horizontal beam supported in an elevated position;

at least a first main hoist assembly including:

a main trolley moveably mounted to the beam in a positively drivable manner; and a main lifting cable suspending a main block from the main trolley in a vertically moveable manner;

at least a first auxiliary hoist assembly including:

an auxiliary trolley moveably mounted to the beam independently of the main lifting hoist assembly in a freely movable manner along the beam; and an auxiliary lifting cable suspending an auxiliary block from the auxiliary trolley in a vertically moveable manner;

wherein the main and auxiliary blocks are securable to a load, whereby the load is pivotable by vertically moving the main and auxiliary blocks relative to each other so that the auxiliary trolley automatically moves along the beam to maintain a substantially vertical orientation above the auxiliary block when the load is pivoted.

2. A crane according to claim 1, wherein said auxiliary trolley includes a plurality of roller wheels mounted to rollably support the auxiliary trolley on said beam.

3. A crane according to claim 1, further comprising:

a drum rotatably mounted relative to said beam, a first end of said auxiliary lifting cable being coilable around said drum; and a motor drivably coupled to rotate the drum to selectively retract or feed said auxiliary lifting cable to vertically move said auxiliary block.

4. A crane according to claim 3, wherein a second end of said auxiliary lifting cable is fixed relative to said beam at an end of said beam opposite said drum.

5. A crane according to claim 1, wherein said auxiliary trolley includes:

an auxiliary trolley body; and a plurality of freely rotatable sheaves rotatably mounted on the auxiliary trolley body for guiding said auxiliary lifting cable.

6. A crane according to claim 1, further comprising a second horizontal beam which is parallel to said first horizontal beam, said second horizontal beam being equipped a second main hoist assembly and a second auxiliary hoist assembly.

7. A crane according to claim 1, wherein said auxiliary hoist assembly has a lifting capacity of approximately 50% of a lifting capacity of said main hoist assembly.

8. A crane comprising:

at least one horizontal overhead beam;

a main lifting trolley mounted in a positively drivable manner on the beam, said main trolley supporting a retractable main lifting cable; and an auxiliary trolley mounted in a freely slidable manner along the beam independently of the main trolley the auxiliary trolley supporting a retractable auxiliary lifting cable.

9. A crane according to claim 8, whereby said auxiliary trolley automatically travels horizontally along said beam in response to a substantial horizontal force component on said auxiliary lifting cable in a direction parallel to said beam.

10. A crane according to claim 8, wherein said auxiliary trolley includes a plurality of roller wheels which rollably support the auxiliary trolley on said beam.

11. A crane according to claim 8, further comprising:

a rotatable drum secured relative to said beam, said auxiliary lifting cable being coilable around said drum; and a drive coupled to rotate the drum for retracting said auxiliary lifting cable.

12. A crane according to claim 8, wherein said auxiliary lifting cable has a first end coupled to a rotatable drum near a first end of said beam and a second end coupled in a fixed manner near an opposite end of said beam, the cable forming a loop through the trolley, the loop suspending an auxiliary lifting block from the trolley so that rotation of said drum causes vertical movement of said auxiliary lifting block.

13. A crane according to claim 8, wherein said auxiliary trolley includes:

an auxiliary trolley body; and a plurality of freely rotatable sheaves rotatably mounted on the auxiliary trolley body for guiding and supporting said auxiliary lifting cable.

14. A method of lifting and pivoting a load, the method comprising the steps of:

providing a horizontal beam, a main trolley mounted to move along the beam in a positively drivable manner and supporting a main lifting cable, and an auxiliary trolley mounted to move in a freely slidable manner along the beam and supporting an auxiliary lifting cable;

securing the lifting cables to the load at respective lifting points, the lifting points being separated by a distance;

suspending the load by the lifting cables;

actuating at least one of the lift cables to cause a vertical movement of one of the lifting points relative to the other lifting point so that the load is pivoted; and permitting the auxiliary trolley to freely move along the beam to maintain a substantially vertical position over its lifting point.

15. A method as defined in claim 14, wherein said actuating step includes retracting said auxiliary lifting cable while said main lifting cable is not retracted.

16. A method as defined in claim 14, wherein said suspending steps includes simultaneously retracting said main auxiliary lifting cables.

17. A method as defined in claim 14, further comprising:

providing a main hook block suspended from said main trolley by said main lifting cable; and providing an auxiliary hook block suspended from said auxiliary trolley by said auxiliary lifting cable;

wherein said suspending step includes securing the main and auxiliary hook blocks to the load.

18. A method as defined in claim 14, wherein an end of the auxiliary lifting cable is coilable around a drum, and wherein said actuating step includes rotating said drum.

* * * * *